United States Patent [19]

Selisky

[11] Patent Number: 4,789,270

[45] Date of Patent: Dec. 6, 1988

[54] DIVING WEIGHT

[76] Inventor: Steven L. Selisky, 2109 Gunflint Trail, Brooklyn Park, Minn. 55444

[21] Appl. No.: 86,883

[22] Filed: Aug. 19, 1987

[51] Int. Cl.[4] ..... B63C 11/30

[52] U.S. Cl. ..... 405/186; 405/185

[58] Field of Search ..... 405/186, 185; 441/102, 441/106, 108; 114/315; 2/311, 316

[56] References Cited

U.S. PATENT DOCUMENTS

| | | | |
|---|---|---|---|
| 1,701,453 | 2/1929 | Hirsh | 2/311 X |
| 3,039,273 | 6/1962 | Swindell | 405/186 |
| 3,064,271 | 11/1962 | Kuber | 2/311 |
| 3,470,570 | 10/1969 | Christiansen | 405/186 |
| 3,808,824 | 5/1974 | Johnston et al. | 405/186 |
| 3,851,488 | 12/1974 | Schuler | 405/186 |

FOREIGN PATENT DOCUMENTS

| | | | |
|---|---|---|---|
| 1107545 | 5/1961 | Fed. Rep. of Germany | 405/186 |

*Primary Examiner*—Dennis L. Taylor
*Attorney, Agent, or Firm*—James R. Cwayna

[57] ABSTRACT

A diving weight for scuba and other divers particularly designed to hold the weight in conformance to the diver's body and including a surface finish to prevent or substantially eliminate marring and scratching of the same. Belt receiving slots are provided along the length of the weight with a spacing formulation to hold the weight and maintain the attachment belt in close conformance to the user's body. The slots and weight are designed to allow the belt to pass from a recessed interior surface thereof about a recessed portion of the exterior surface and back to the interior thereof to hold the weight close to the user's body. The interior and exterior recesses of the weight allow for close conformity of the belt to the weight and the weight to the user's body. The weight is shaped with a radius on all mating surfaces to facilitate dipping and coating of the weight with a vinyl material. The vinyl material provides and is selected to provide a matte finish to the entire exterior surfaces of the weight, including the slot surfaces. The matte finish substantially eliminates the appearance disfiguration as compared to smoothly coated weights.

6 Claims, 2 Drawing Sheets

DIVING WEIGHT

FIELD OF THE INVENTION

This invention relates generally to divers weights and the coating of such weights.

SHORT SUMMARY OF THE INVENTION

A divers weight particularly for scuba divers which is particularly designed to bring the weight into close conformity to the user's body and thereby prevent tipping or gapping of the weight from the user's body. The belt slots of the weight are particularly spaced along the length of the weight to provide a close, body-fit relation to eliminate gapping areas between the belt, weight and the user's body. The gap normally results from a weight and belt not held in conformance to the body which will tip away from the body.

The weight of the invention is coated with a vinyl-matte finish to substantially eliminate marring and scratching of the finish and maintain an attractive finish.

The shape of the weight includes radiused ends and side sections to accommodate uniform and total coating of the weight. The weight is radiused on all mating edges and this radiusing effect improves the dipping qualities of the unit into the vinyl material for a uniform and continuous coating without resultant thinned areas.

BACKGROUND AND OBJECTS OF THE INVENTION

The applicant is well aware of the commercially available divers weights and it is his opinion that the concepts disclosed in this application are clearly distinct from any such commercial units. In addition to such a commercial art search, the applicant has searched the prior art patents and has found U.S. Pat. Nos. to Christianse, 3,220,197; Swindell, 3,039,273; Di Julio, 2,970,448; Apperson, 3,192,723; Finnern, 4,455,718; and, Johnston, et al, 3,808,824.

Of all of these patents, the only patent which discloses a unit having belt receiving slots formed therein is the patent t Finnern and this weight is disclosed only in combination with a particular strap to permit rapid jettison of the weight from a scuba tank. The weight illustrated in the Finnern patent is not the principal consideration of the patent and importance and patentability is directed to the strap for holding the weight to a tank. This patent does not consider the concept of conforming the weight and strap combination to the body of a user and neither the Finnern nor any other reference as found, disclose a matte finish to be applied to a weight.

It is therefore an object of the applicant's invention to provide a diving weight having a specific belt receiving slot configuration to hold the weight in close conformity to the user's body and eliminate normal belt gap areas about the user's body.

It is a further object of the applicant's invention to provide a divers weight having a specific configuration to receive a belt from the interior to the exterior thereof with the length between belt receiving slots being established with relation to the total length of the weight with this same mathematical construction and slot arrangement applicable to weights of all sizes.

It is still a further object of the applicant's invention to provide a diving weight which includes a vinyl coating entirely thereover including the belt receiving slots with the vinyl material providing a matte finish over the entire surface of the weight, the matte finish essentially reducing the possibility of marring and scratching of the finish of the weight and maintaining the appearance of the weight through long useage.

These and other objects and advantages of the applicant's invention will more fully appear from a consideration of the accompanying disclosure and drawings.

DESCRIPTION OF A PREFERRED FORM OF THE INVENTION

Figure 1:
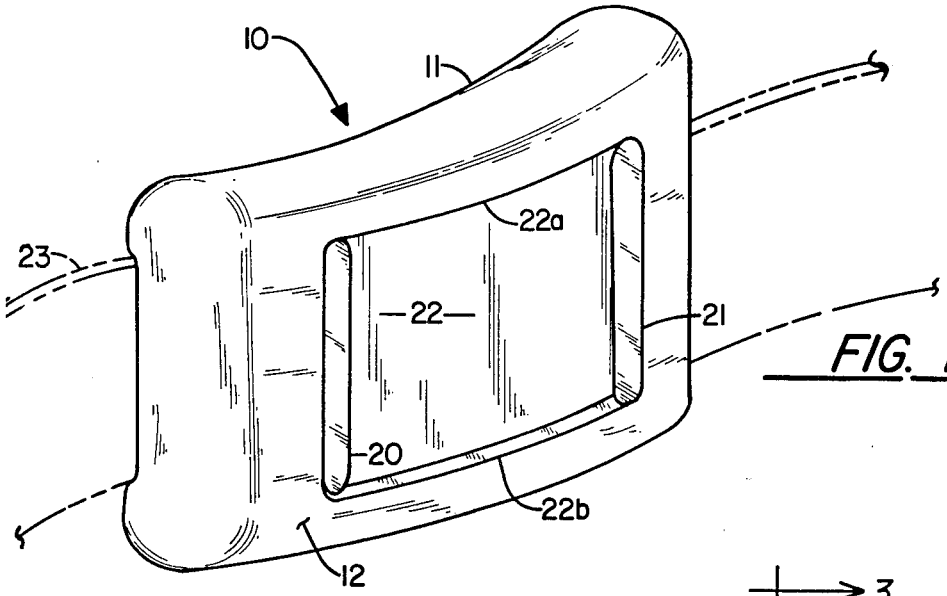
FIG. 1 is a perspective view of the diving weight embodying the concepts of the applicant's invention and illustrating an attachment belt arranged therein, the belt being illustrated in phantom line position and not being and not forming a portion of the invention.

As illustrated in the accompanying drawings the divers weight embodying the concepts of the applicant's invention is generally designated 10 and the belt utilized to attach the same to a diver is illustrated in FIG. 1 in phantom lines and designated B. The weight 10 is molded of lead or combination thereof. It should be understood that a number of such weights 10 may be carried on a single belt B depending upon the specific diving requirements and that the weight for use by individual divers may vary, again, in accordance with the divers needs and wishes.

Figure 4:
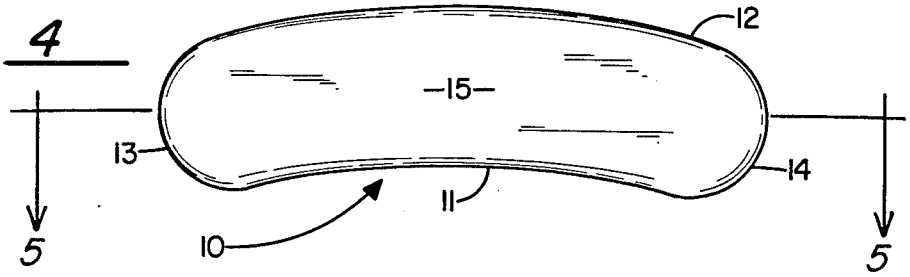
FIG. 4 is a top plan view of the weight.

As illustrated in the accompanying drawings, the weight 10 is of a predetermined size with an inner surface 11 and outer surface 12 with the inner surface 11 being of a first curvature of a given radius with the exterior surface 12 being of an increased radial curvature. As particularly illustrated in FIG. 4, ends 13–14 of the weight are smoothly radiused as are the top 15 and bottom 16. Similarly all respective corners are smoothly radiused with the radii being selected to assist in the dipping and vinyl coating process. A suggested radius for proper dipping is three-quarters of an inch.

A pair of belt receiving slots 20–21 are formed through the body of the weight 10 to extend from the inner surface 11 to the outer surface 12 and a depressed area 22 is formed in the outer surface 12 of the weight 10 such that a belt B passing through the slots 20–21 will position the exterior surface thereof in substantial alignment with the exterior surface 12 of the weight 10 so as not to protrude beyond the outer surface thereof.

As also noted the inner surface 11 of the weight 10 is provided with recessed areas **11*a*–11*b* positioned exteriorly of slots 20–21 such that the belt B may be received in the recessed areas and again, lie in substantial conformity to the interior surface 11 of the weight 10**.

As particularly noted in various figures, this depressed area 22 is provided with an upper 22a and lower 22b shoulder at the upper and lower limits thereof and that the side limits of the depressed area 22 is defined by the respective slots 20–21. Belt B then lies, when in use, within and against the depressed area 22 and against areas 11a–11b of the interior surface 11, which areas are longitudinally exterior of slots 20–21.

This particularly belt-slot configuration and weight curvature arrangement then brings the interior surface 11 of the weight 10 directly against the diver's body and eliminates what may be termed belt gap. Belt gap exists when, for example, the belt passes through the middle of a weight or around the exterior surface thereof such that the belt does not hold adjacent to the user's body.

Figure 2:
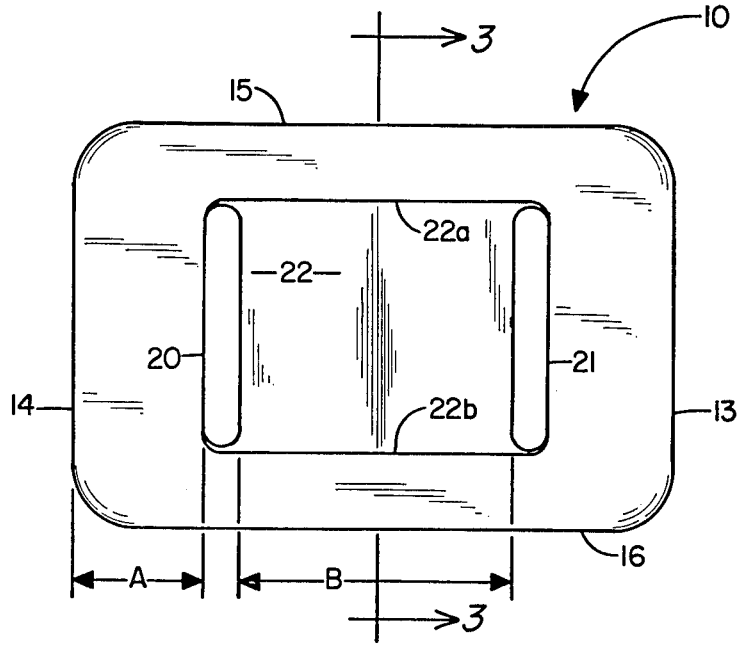
FIG. 2 is an elevation of the weight from the exterior surface thereof.

In order to eliminate belt gap and in order to hold the weight in close adjacent position to the user's body the applicant has formulated a particular relationship between the dimension between slots 20–21 and the dimension of the interior areas 11a–11b of the weight 10. As particularly illustrated in FIG. 2 the area covering interior depressed areas 11a–11b is designated A and the dimension of the depressed area 22 is designated B. The applicant has found that, in order to prevent gapping and in order to properly hold the weight in position on the user's body the relationship of B:A should be 2:1. The particular dimension of the respective slots 20–21 simply permits ease of passing a commercially available belt therethrough.

With the radial configurations, proper coating of the unit is obtained. With the prior art, applicant has found that incomplete or thin coating areas may exist when the weight is of square or minimally radiused design. With the applicant's configuration proper even coating is obtained over all surfaces and particularly within the belt passing slots 20–21.

Figure 3:
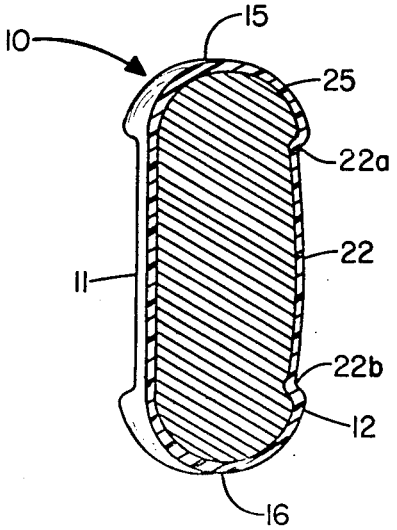
FIG. 3 is a section taken substantially along line 3—3 of FIG. 2 and illustrating the vinyl coating that is applied to the weight.
Figure 5:
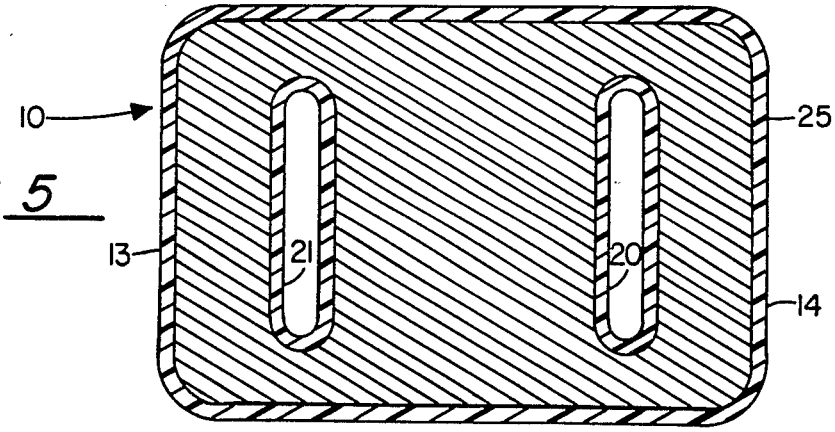
FIG. 5 is a vertical section taken substantially along line 5—5 of FIG. 4 and again illustrating the vinyl coating provided on the weight and illustrating the vinyl coating within the belt slot openings.
Figure 6:
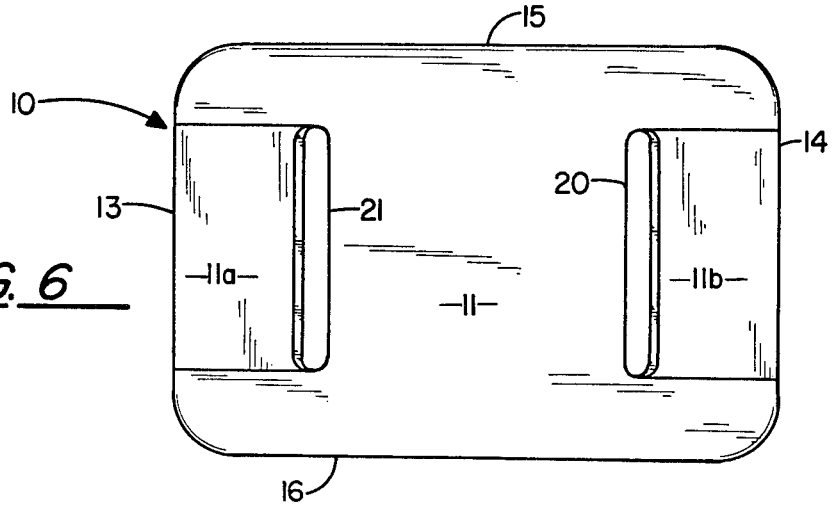
FIG. 6 is an elevation of the weight and taken from the interior side of the weight, opposite the view of FIG. 2.
Figure 7:
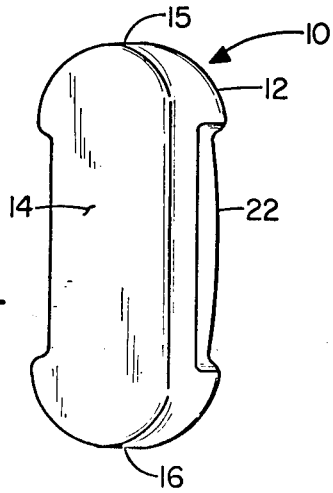
FIG. 7 is a side elevation of the weight.

In the accompanying drawings, particularly FIGS. 3 and 5, the coating is designated in its entirety 25. Applicant provides a plastic material coating and preferrably a vinyl coating and this coating is derived from a material which provides a matte finish to all exterior surfaces of the weight 10. Applicant has found that the presently available, commercial weights have a smooth coating and this coating is easily marred or scratched, resulting in a poor appearance in a realtively short period of use. With the matte finish, the surface is less easily marred or scratched and if it is marred or scratched the outward appearance of the weight is not as greatly detracted as a weight of smooth finish.

With the applicant's design and finishing of a divers weight several advantages exist. These advantages include the close conformance of the weight and belt to the user's body and the advantage of the matte finish of the weight to eliminate or at least reduce the used appearance of the weight.

It is the applicant's consideration that these advantages do not appear in the prior art and that the design of his weight, as disclosed and illustrated herein provide a new and unique departure from prior art.

What is claimed is:

1. A divers weight for use with a belt for holding the weight to the user's body, said weight including:

a. a longitudinally extending body having an internal and an external surface, a top, bottom and ends;

b. a pair of belt passing slots formed through said body from said internal to said external surface of said body and spaced a predetermined distance from said ends of said body;

c. depressed belt receiving and locating areas formed on both said internal and external surfaces of said body, said depressed area on said external surface being formed between said slots and said depressed areas of said internal surface being formed laterally externally of said slots; and, d. the belt being of a first thickness and the depth of said depressed areas being at least equal to the thickness of the belt such that the belt is substantially received into said depressed areas and not extend outwardly or inwardly beyond the undepressed areas of said surfaces.

2. The divers weight as set forth in claim 1 and the junctures of said internal and external surfaces, top, bottom and ends of said body being radiused.

3. The divers weight as set forth in claim 2 wherein the radius of said junctures is three fourths of an inch.

4. The divers weight as set forth in claim 1 and said slots being positioned at a predetermined location from said ends of said body and from one another to provide holding of said weight to the body of the user thereof entirely vertical thereof to eliminate spacing between the user's body and said weight and the belt.

5. The divers weight as set forth in claim 4 and the spacing of said slots from the respective ends being of a first dimension and the spacing of said slots from one another being of a second dimension double of said first dimension.

6. The divers weight as set forth in claim 1 and a. all exterior surfaces, including said belt passing slots being coated with a plastic vinyl material; and, b. said vinyl material providing a matte finish to said exterior surfaces of the weight.

* * * * *